343-754 SR
4/3/79 OR 4,148,035

United States Patent [19] [11] 4,148,035
Foldes [45] Apr. 3, 1979

[54] SUBWAVELENGTH MONOPULSE ANTENNA

[75] Inventor: Peter Foldes, Wayne, Pa.
[73] Assignee: RCA Corp., New York, N.Y.

[21] Appl. No.: 860,870
[22] Filed: Dec. 14, 1977
[51] Int. Cl.[2] ..... H01Q 13/02
[52] U.S. Cl. ..... 343/754; 343/777; 343/786
[58] Field of Search ..... 343/16 M, 753, 754, 343/755, 777, 786, 854

[56] References Cited

U.S. PATENT DOCUMENTS 3,906,508 9/1975 Foldes ..... 343/786

*Primary Examiner*—Eli Lieberman
*Attorney, Agent, or Firm*—H. Christoffersen; J. D. Lazar

[57] ABSTRACT

A sum channel waveguide is excited in a $TE_{11}$ mode to cause a radio frequency wave to propagate therefrom through a cylindrical multimode waveguide. The wave propagates via a discontinuity that causes the multimode waveguide to be excited in the $TE_{11}$ mode and higher order modes. The multimode waveguide is coupled to free space via a dielectric lens and a cup shaped matching section, whereby the wave causes a beam to be radiated from the lens. The cavity of the multimode waveguide is contiguous with a plurality of arcuate cavities of a difference channel waveguide. The beam is deflected in response to excitation of the arcuate cavities.

10 Claims, 14 Drawing Figures

SUBWAVELENGTH MONOPULSE ANTENNA

BACKGROUND OF THE INVENTION

1. Field of the Invention

This invention relates to microwave radiation and more particularly to a radiator suitable for use with either a monopulse radar or a communication tracking system where the radiator is mounted within a limited space.

2. Description of the Prior Art

When a military aircraft is being pursued by a vehicle, such as a missile or an enemy aircraft, survival of the military aircraft usually depends upon detecting the pursuing vehicle. Typically, the military aircraft has a monopulse radar for detecting the pursuing vehicle.

The radar includes an antenna mounted near the stabilizer portion of the tail of the military aircraft. Because the antenna is mounted near the stabilizer, the radar scans a spatial region aft of the military aircraft. The antenna includes a plurality of difference channel radiating horns disposed about a sum channel radiating horn.

The antenna transmits a beam that combines radiation from the sum channel horn and with radiation from a selected one of the difference channel horns. Since the difference channel horns are disposed about the sum channel horn, the direction of the beam is related to the disposition and phase of excitation of the selected difference channel horn. When the difference channel horns radiate sequentially, the radiation from the sum channel horn and the difference channel horns combine to cause the maximum of the beam to conically scan the spatial region.

When the radar operates a low frequencies, the size of such an antenna makes it difficult to mount near the stabilizer. The size may conceptually be reduced by combining the sum and difference channel horns into a single multimode horn. Furthermore, since the wavelength of an electromagnetic wave in a medium is inversely related to the dielectric constant of the medium, an antenna of reduced size may comprise a single horn loaded with a material that has a high dielectric constant. However, matching the antenna of reduced size to free space is difficult when there is a large difference between the dielectric constants of the material and free space.

SUMMARY OF THE INVENTION

According to the present invention, a cylindrical multimode waveguide has one end adjacent to a circular launching aperture and the other end connected to a cylindrical sum channel waveguide. In response to excitation of the sum channel waveguide, a radio frequency sum mode wave propagates therefrom through the multimode waveguide. The launching aperture is coupled to a spherical lens made from a material having a dielectric constant greater than the dielectric constant of free space, whereby a forward wave is radiated from the lens and a backward wave is reflected from the outside surface of the lens toward the launching aperture. A matching section reflects a portion of the forward wave toward the lens to cancel the backward wave, thereby matching the lens to free space. The cavity of the multimode waveguide is contiguous with a pair of diametrically opposed cavities of a difference channel waveguide that is circumferentially disposed about the multimode waveguide. In response to excitation of the diametrically opposed cavities, a difference mode wave propagates through the launching aperture and is thereby combined with the sum mode wave.

Figure 7:
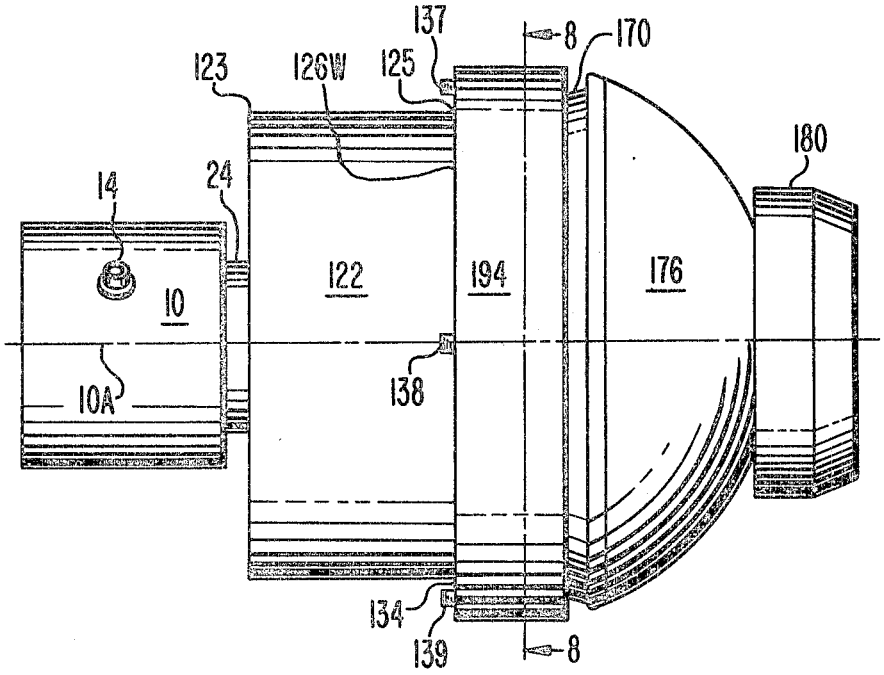
FIG. 7 is a side elevation of a radiator in accordance with a second embodiment of the present invention.
Figure 10:
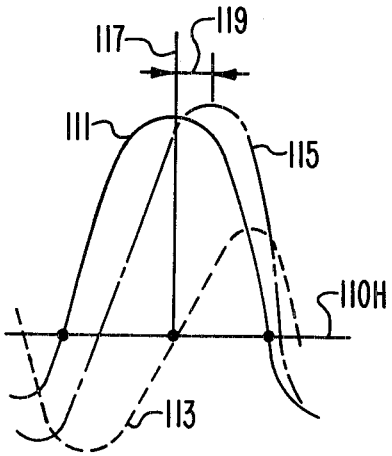
Figure 11:
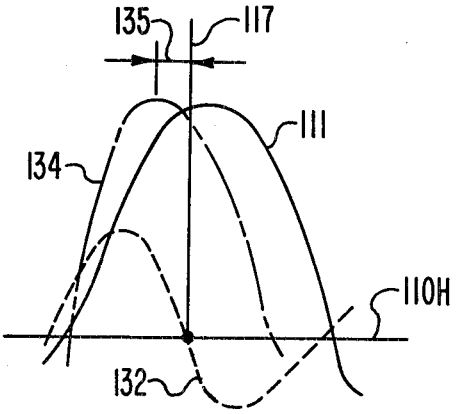

FIGS. *9a–9d* are field patterns of difference mode fields within the radiator in the embodiment of FIG. 7;

FIG. 10 is a graphic representation of fields within the radiator in the embodiment of FIG. 7 and a beam that radiates therefrom; and FIG. 11 is a graphic representation of fields within the radiator in the embodiment of FIG. 7 and a beam that radiates therefrom.

DESCRIPTION OF THE PREFERRED EMBODIMENT

In the present invention a radio frequency (rf) wave propagates through a monopulse radiator to form a forward wave that is radiated as a beam in a far field. Most of the rf wave is propagated in the $TE_{11}$ mode to a launching aperture of the radiator.

The forward wave is radiated from a spherical lens comprised of a material that has a dielectric constant greater than that of free space. Additionally, a matching section reflects a portion of the forward wave back to the lens to cancel a backward wave that is internally reflected from the surface of the lens.

In a first embodiment of the invention, the beam is reflected in a selected plane in response to excitation of a difference channel of the radiator. The difference channel excitation causes difference mode waves to be propagated through the launching aperture simultaneously in a $TM_{01}$ mode and in a $TE_{21}$ mode. Since the beam is deflected in the selected plane, the beam may, for example, alternatively be deflected in azimuth or elevation.

When an exemplary rf wave propagates in the $TE_{21}$ mode through a cylindrical waveguide, the cavity of the waveguide must have a minimum diameter of 0.972 wavelengths of the exemplary wave. When the exemplary wave propagates through the cylindrical waveguide in the $TE_{11}$ and $TM_{01}$ modes, the diameter of the waveguide may be less than 0.972 wavelengths of the exemplary wave.

Since the difference mode waves propagate simultaneously in the $TE_{21}$ mode and the $TM_{01}$ mode, the minimum diameter of the aperture of the radiator is 0.972 wavelengths. However, a measured wavelength within the cylindrical waveguide is inversely proportional to the square root of the dielectric constant of a medium that fills the cavity of the waveguide. Accordingly, to achieve small size, the radiator is loaded with a material that has a dielectric constant greater than the dielectric constant of free space. The term, wavelength, refers hereinafter to the length of a wave within the radiator.

As shown in FIGS. 1–4, the radiator includes a cylindrical sum channel waveguide 10 (FIGS. 1 and 2) with a central axis 10A. Waveguide 10 has a cavity loaded with a material that has a dielectric constant which is selected in a manner explained hereinafter. The cavity of waveguide 10 has an inside diameter slightly larger than 0.567 wavelengths. As known to those skilled in the art, because waveguide 10 has an inside diameter slightly larger than 0.567 wavelengths, a radio frequency wave propagates therethrough only in the $TE_{11}$ mode.

Waveguide 10 has a wall 12 that carries a coaxial connector 14 with a probe 16 which extends through wall 12. Probe 16 has a length of approximately one-quarter of a wavelength, thereby providing a low reflection transition between connector 14 and waveguide 10. Preferably, probe 16 has a displacement of approximately one-quarter of a wavelength from an end wall 18 of waveguide 10, thereby causing an rf were that propagates from probe 16 to end wall 18 to be reflected therefrom in phase with an rf wave that propagates directly from probe 16 away from end wall 18. A sum mode rf wave propagates in the $TE_{11}$ mode through waveguide 10 in the direction of an arrow 20 in response to a sum channel excitation signal being applied to connector 14.

Waveguide 10 is coaxially connected to a multimode cylindrical waveguide 22 at an end 23 thereof through a coupling iris 24, which is described hereinafter. Waveguide 22 and coupling iris 24 are both disposed coaxial with axis 10A. The sum mode wave propagates from waveguide 10 to waveguide 22.

Like waveguide 10, waveguide 22 has a cavity loaded with the dielectric material. However, the cavity of waveguide 22 has a diameter that is greater than the 0.972 wavelengths, whereby waveguide 22 is suitable for propagation of the sum mode wave and the difference mode waves.

Because the diameter of the cavities of waveguides 10 and 22 differ from each other, the region of coupling iris 24 is referred to in the art as a discontinuity. The discontinuity causes part of the sum mode wave to propagate through waveguide 22 in higher order modes. One of these higher order sum modes is the $TM_{11}$ mode. As explained hereinafter, propagation of part of the sum mode wave in higher order modes is desirable; it causes the radiated beam to have reduced side lobes.

Figure 1:
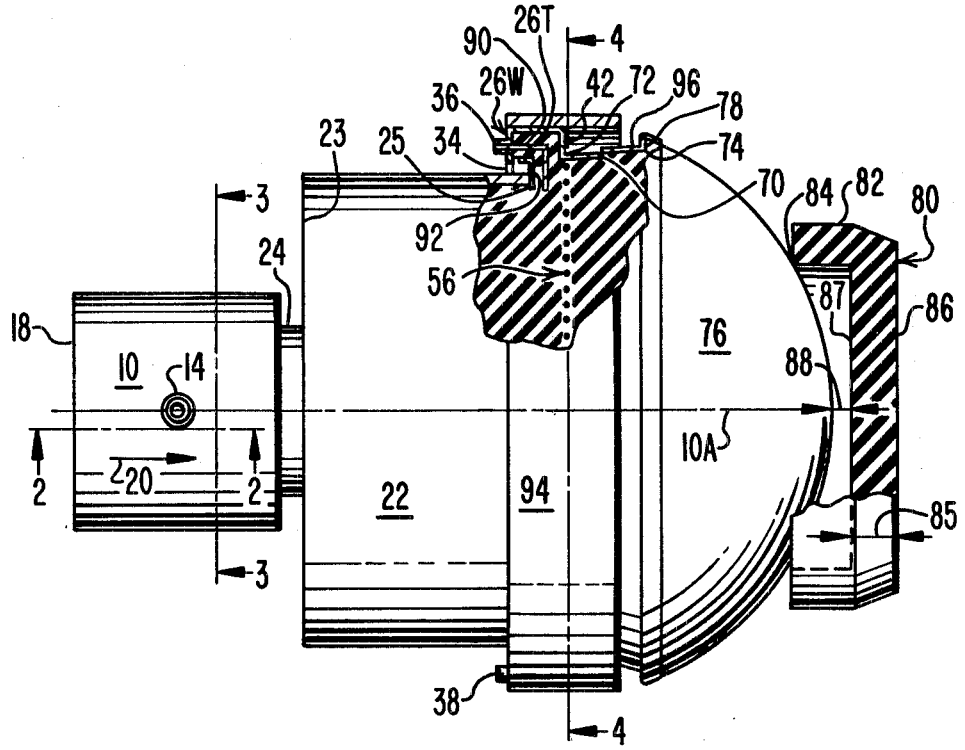
FIG. 1 is a side elevation, with portions broken away, of a radiator in accordance with a first embodiment of the present invention.
Figure 2:
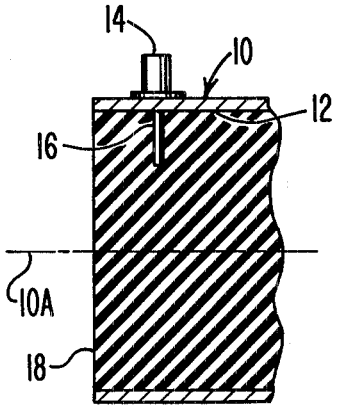
FIG. 2 is a view taken along line 2—2 of FIG. 1.
Figure 3:
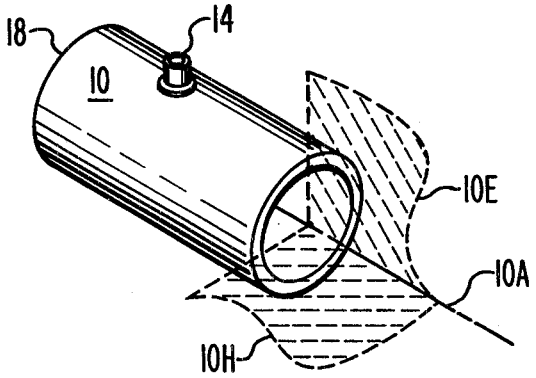
FIG. 3 is a perspective view of a sum channel waveguide and the planes of electric and magnetic field vectors in the embodiment of FIG. 1.

As shown in FIG. 3, a sum mode electric field, associated with the sum mode wave, may be represented by an electric field vector within a plane 10E (referred to in the art as an E plane) that includes axis 10A. Additionally, plane 10E includes a central axis of probe 16 (not shown). A magnetic field associated with the sum mode wave may be represented by a magnetic field vector that is within a plane 10H (referred to in the art as an H plane) which is perpendicular to plane 10E and includes axis 10A.

An end 25 of waveguide 22 (FIG. 1) is integrally connected to a difference channel waveguide 26W that is circumferentially disposed about waveguide 22. Additionally, waveguide 26W has a cavity 26T with an approximately rectangular cross-section, cavity 26T being coaxial with axis 10A and contiguous with the cavity of waveguide 22.

Figure 4:
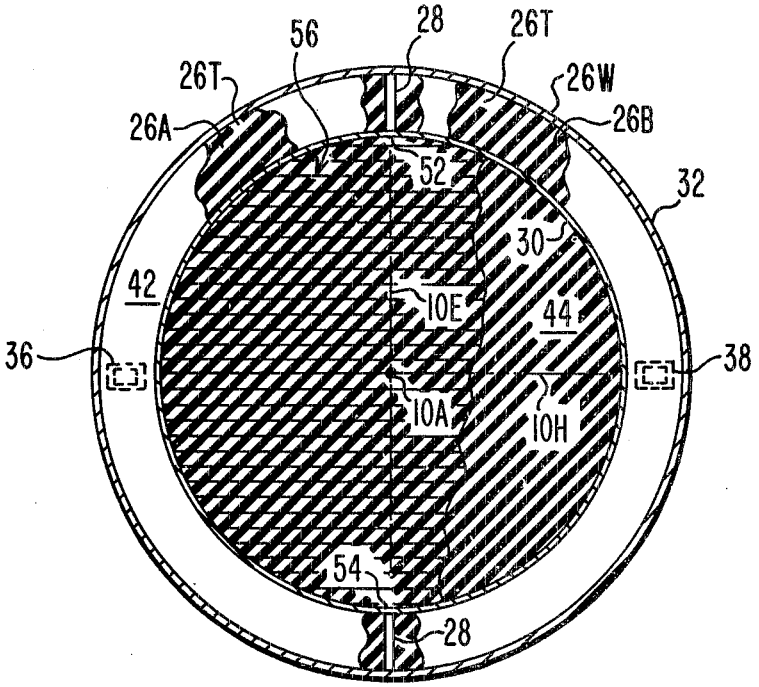
FIG. 4 is a view of a difference channel waveguide of the first embodiment taken along the line 4—4 of FIG. 1.

As shown in FIG. 4, cavity 26T is divided into similar arcuate waveguide cavities 26A and 26B by radial electrically conductive walls 28. Additionally, cavity 26T is bounded by an inner cylindrical wall 50 and an outer cylindrical wall 32.

Cavities 26A and 26B are loaded with the dielectric material. Moreover, the dielectric constant of the dielectric material is selected to cause cavity 26T to have a mean circumference of slightly more than one wavelength, whereby cavities 26A and 26B each have a mean arcuate length of slightly more than one half of a wavelength. Because of the arcuate length, a wave within cavities 26A and 26B propagates parallel to axis 10A in a basic mode that approximates the $TE_{11}$ mode. It should be understood that the basic mode only approximates the $TE_{11}$ mode because cavities 26A and 26B are not rectangular parallelpipeds.

Waveguide 26W has an annular end wall 34 (FIG. 1) wherein ports 36 and 38 communicate with the centers of cavities 26A and 26B, respectively. It should be understood that ports 36 and 38 and the centers of cavities 26A and 26B are on opposite sides of plane 10E and substantially within plane 10H.

Waveguide 26W additionally has an annular wall 42 (FIGS. 1 and 4) that is substantially within a plane that includes a circularly shaped launching aperture 44 (FIG. 4) of the radiator. Launching aperture 44 is coaxial with axis 10A and adjacent end 25. Ports 36 and 38 and launching aperture 44 are described more fully hereinafter.

Figure 5:
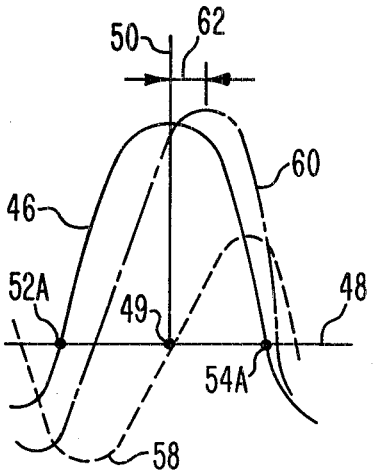
FIG. 5 is a graphic representation of fields within the radiator of the first embodiment and a beam that radiates therefrom.

In the first embodiment, an H plane difference mode excitation is applied to ports 36 and 38 to cause a deflection of the beam in plane 10E. As shown in FIG. 5, in the absence of the H plane difference mode excitation, the strength of the beam in plane 10E is represented by a curve 46. Curve 46 is in a coordinate system where an abscissa 48 corresponds to a line that is within plane 10E and is orthogonal to plane 10H. A location on abscissa 48 is a coordinate representative of an angle subtended by the beam from axis 10A within plane 10E. An origin point 49 on abscissa 48 is representative of axis 10A. The coordinate system additionally includes an ordinate line 50, a location thereon being a coordinate representative of field strength.

Curve 46 intersects abscissa 48 at points 52A and 54A. It should be understood that points 52A and 54A correspond to points 52 and 54 that ae intersected by plane 10E (FIG. 4) on diametrically opposite edges of launching aperture 44. In accordance with the FIG. 5, in the absence of the H plane difference mode excitation, the beam has no component of deflection in plane 10E.

The H plane difference mode excitation is either in phase or out of phase with the sum channel excitation to cause deflections of the beam, as explained hereinafter. In response to the H plane difference mode excitation, an E plane difference mode wave propagates in the basic mode through waveguides 26A and 26D to waveguide 22. Within waveguide 22, the E plane difference mode wave propagates in the $TM_{01}$ mode to launching aperture 44 (FIG. 4). Moreover, since ports 36 and 38 are substantially within plane 10H, the H plane difference mode excitation does not cause a substantial change in the propagation of the sum mode wave.

Because the E plane difference mode wave propagates in the $TM_{01}$ mode, it has a component in plane 10E and a component in plane 10H. The component in plane 10H is undesired because it couples planes 10E and 10H, thereby reducing power associated with the deflection of the beam in plane 10E.

The component in plane 10H is rejected by a multiplicity of closely spaced electrically conductive wires 56 (FIGS. 1 and 4) that are maintained substantially within launching aperture 44 with a disposition orthogonal to plane 10E. Because of the disposition of wires 56, only waves that have a polarization orthogonal to wires 56 pass through launching aperture 44, whereby a filtered E plane difference mode wave propagates through launching aperture 44 with the same polarization as the sum mode wave. The filtered E plane difference mode wave has a component that propagates in the $TM_{01}$ mode and a component that propagates in the $TE_{21}$ mode.

When the H plane difference channel excitation is in phase with the sum channel excitation, the filtered E plane difference mode wave and the sum mode wave combine to cause a first deflection of the beam. The filtered E plane difference mode wave and the beam with the first deflection are represented by curves 58 and 60, respectively (FIG. 5). The first deflection is represented as a displacement 62 from plane 10E along abscissa 48.

Figure 6:
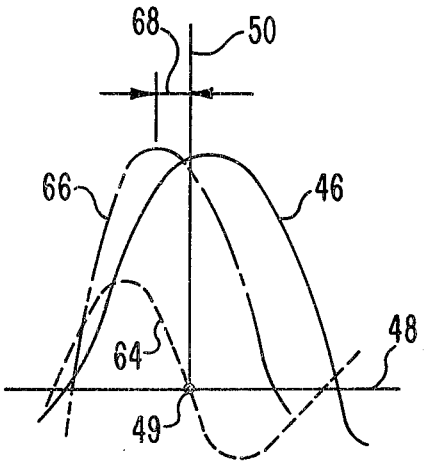
FIG. 6 is a graphic representation of fields within the radiator of the first embodiment and a beam that radiates therefrom.

As shown in FIG. 6, when the H plane difference channel excitation is out of phase with the sum channel excitation, the filtered E plane difference mode wave and the sum mode combine to cause a second deflection of the beam. The filtered E plane difference mode wave and the beam with the second deflection are represented by curves 64 and 66, respectively. The second deflection is represented as a displacement 68 from plane 10E along abscissa 48.

A matched impedance coupling of the difference mode waves through launching aperture 44 is provided when iris 24 is disposed as explained hereinafter and is of a size small enough to cause it to be a short circuit termination for a wave that is propagated in the $TM_{01}$ mode and large enough to pass a wave that is propagated in the $TE_{11}$ mode. It should be understood that the short circuit termination for the wave that is propagated in the $TM_{01}$ mode, is a short circuit termination for a wave that is propagated in the $TE_{21}$ mode. It should be understood that a wave that is incident to a short circuit termination is reflected therefrom.

Iris 24 is disposed approximately one quarter wavelength from cavities 26A and 26B. Because of the size and the disposition of iris 24, the difference mode waves that propagate directly from cavities 26A and 26B through launching aperture 44 are added in phase with the difference mode waves that propagate to iris 24 and are reflected therefrom, whereby the matched coupling is provided. It should be understood that iris 24 is loaded with the dielectric material.

As known to those skilled in the art, the width of a radar beam that is radiated in a given plane by an antenna is inversely proportional to the width of the aperture of the antenna in the given plane. Because launching aperture 44 is usually small, it would radiate an undesirably wide beam. Moreover the dielectric constant of the dielectric material is substantially dissimilar from the dielectric constant of free space, thereby causing the impedance of the radiator at launching aperture 44 to be poorly matched to the impedance of free space.

In order to provide a radiating aperture of a suitable size, launching aperture 44 is coupled to a coupling waveguide 70 (FIG. 1) made from the dielectric material. Waveguide 70 has the general shape of a right truncated cone with a small diameter end 72 and a large diameter end 74 integrally connected to wall 42 and a spherical lens 76 at a lens aperture 78, respectively. Because waveguide 70 is made from the dielectric material, the connection of the metal of wall 42 to end 72 is a discontinuity that causes a propagation of waves in high order modes through waveguide 22.

The sum mode wave and the difference mode waves combine to provide a forward wave that propagates through launching aperture 44 and waveguide 70. The conical shape of waveguide 70 causes a divergence of the forward wave, thereby causing the forward wave to have a curved wavefront whereby portions of the forward wave have phase differences in a cross-sectional plane of waveguide 70. The phase differences are known as a quadratic phase error. As known to those skilled in the art, a quadratic phase error causes an antenna to have a reduced gain. Additionally, the quadratic phase error causes the radiation pattern of an antenna to have increased sidelobes. As explained hereinafter, the quadratic phase error is corrected by lens 76.

Lens 76 is made from the dielectric material. Additionally, the center of curvature of lens 76 is substantially at the center of launching aperture 44. The optical axis of lens 76 is coaxial with axis 10A. Because of the spherical shape of the outside surface of lens 76 and the location of the center of curvature thereof, lens 76 corrects the quadratic phase error whereby the beam propagates from lens 76 with a plane wavefront.

As known to those skilled in the art, waveguides 22, 70 and 90 and lens 76 form an end fire type of radiating system. However, lens aperture 78 causes an aperture type of radiation, whereby a combined aperture and end fire type of radiation is provided by the radiator. The combined aperture and end fire type of radiation causes the beam to be more directional than a beam provided by an aperture radiator. Moreover, the radiation pattern of the radiator has sidelobes lower than those in the radiation pattern of an aperture radiator.

Because the dielectric constant of lens 76 is different from that of free space, a portion of the forward wave is reflected from the surface of lens 76, thereby causing a backward rf wave to propagate toward the launching aperture. In this embodiment, a cup shaped matching section 80, made from the dielectric material, is utilized to cancel the backward wave as explained hereinafter.

Matching section 80 has a lip 82 with an edge 84 which is integrally connected to lens 76. Additionally, matching section 80 is axially symmetric about axis 10A.

A portion of the forward wave is reflected back toward lens 76 from matching section 80, thereby providing a reflected wave that propagates toward lens 76. The reflected wave is additively combined with the backward wave.

The magnitude of the reflected wave is a function of a distance 85 between surfaces 86 and 87 of matching section 80. The phase of the reflected wave at the surface of lens 76 is a function of a distance 88 of surface 86 from lens 76. Distances 85 and 88 are selected to cause the backward and reflected waves to be of equal amplitude and opposite phase whereby the reflected wave cancels the backward wave.

As well known to those skilled in the art, the radiation pattern of an antenna is the Fourier transform of the electric field distribution in the aperture of the antenna. Moreover, the Fourier transform of one axially symmetric Gaussian function is another axially symmetric Gaussian function. A radiation pattern that is an axially symmetric Gaussian function is free of sidelobes. Although an infinite aperture size is required for an axially symmetric Gaussian field distribution, it is desirable to approximate the axially symmetric Gaussian field distribution at the surface of lens 76.

An approximate Gaussian field distribution within waveguide 22 is provided by propagating a portion of the sum mode wave in higher order modes (in addition to the portion propagated in the $TE_{11}$ mode). The portions propagated in the higher order modes combine with the portion propagated in the $TE_{11}$ mode to cause the approximate Gaussian field distribution within waveguide 22. By providing the approximate Gaussian field distribution within waveguide 22, an approximate Gaussian field distribution is provided at the surface of lens 76.

As explained hereinbefore, because of iris 24, a portion of the sum mode wave is propagated through waveguide 22 in the $TM_{11}$ mode. Other higher order modes of propagation of portions of the sum mode wave are caused by the discontinuity formed by the connection of wall 46 to end 72.

The phase of a wave in an exemplary cylindrical waveguide is a function of a propagation constant and an axial distance in the exemplary waveguide from a plane where the wave is generated. However, differing modes of propagation are associated with differing propagation constants. An axial length of waveguide 10 is selected to cause the portions of the sum mode wave to have desired relative phases, whereby the portion of the sum mode wave combine to cause the approximate Gaussian distribution of the field at the surface of lens 76.

As known to those skilled in the art, the amplitude of the difference mode waves depend upon the construction of ports 36 and 38. Ports 36 and 38 each include a coaxial probe 90 that extends to a side wall 92 of waveguide 26W. The amplitudes of the difference mode fields that propagate through cavities 26A and 26B are selected by adjusting the position of probes 90 within connectors 36 and 38, respectively.

It should be appreciated that there may be an undesired radiation from the surface of waveguide 70. The undesired radiation is reduced by a choke formed from a hollow cylinder 94 that has one part of its inside surface in contact with the outer surface of waveguide 26W and the other part of its inside surface opposite the surface of waveguide 70. The choke additionally includes a metallic deposit 96 that extends over a portion of the aperture of lens 76 and a portion of the surface of waveguide 70 near end 74. End 74 is one quarter of a wavelength from wall 46, whereby cylinder 94 and deposit 96 substantially form a waveguide with a short circuit termination in the region of metal deposit 96.

In a second embodiment of the invention, the beam is alternately deflected in planes 10E and 10H to provide a conical scan. The deflection in plane 10H is caused by an H plane difference mode wave that propagates in the $TE_{12}$ mode.

When an exemplary wave propagates in the $TE_{12}$ mode through a cylindrical waveguide, the cavity of the waveguide must have a minimum diameter of 1.697 wavelengths of the exemplary field. Since the H plane difference mode fields propagate in the $TE_{12}$ mode, the minimum diameter of the aperture of the radiator is 1.697 wavelengths.

Figure 8:
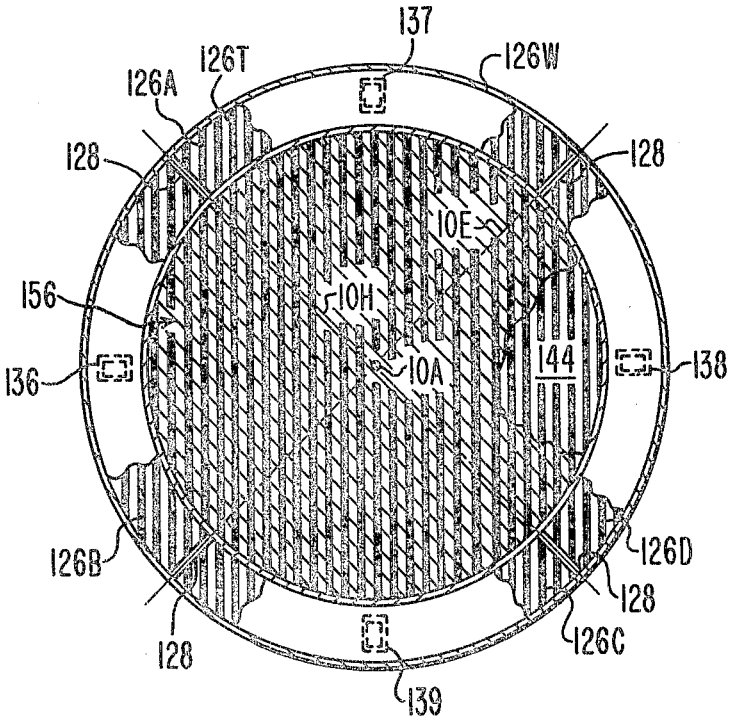
FIG. 8 is a view of a difference channel waveguide of the second embodiment taken along the line 8—8 of FIG. 7.

As shown in FIGS. 7 and 8, waveguide 10 is connected to a multimode cylindrical waveguide 122 (FIG. 7) at an end 123 thereof through coupling iris 24. Waveguide 122 is similar to waveguide 22 described in connection with the first embodiment. Like the cavity of waveguide 22, the cavity of waveguide 122 is loaded with the dielectric material. However, unlike waveguide 22, waveguide 122 has a diameter that is greater than 1.697 wavelengths, whereby waveguide 122 is suitable for propagation of the H plane difference mode waves.

The radiator of the second embodiment has a circularly shaped launching aperture 144 (FIG. 8) adjacent an end 125 of waveguide 122 (FIG. 7). Moreover, a multiplicity of closely spaced wires 156 (FIG. 8), similar to wires 56 are maintained substantially within launching aperture 144; the wires are disposed orthogonal to plane 10E.

A difference mode waveguide 126W is circumferentially disposed about waveguide 122. Additionally, waveguide 126W is integrally connected to end 125.

Waveguide 126W (FIG. 8) has a cavity 126T that is coaxial with axis 10A and contiguous with the cavity of waveguide 122. Moreover, cavity 126T is divided into similar arcuate waveguide cavities 126A–126D by radial electrically conductive walls 128. Additionally, cavities 126A and 126C form a first pair of opposed cavities and cavities 126B and 126D form a second pair of opposed cavities.

Cavities 126A–126D are loaded with the dielectric material. However, in the second embodiment the dielectric constant of the dielectric material is selected to cause cavity 126T to have a mean circumference slightly larger than one wavelength, whereby cavities 126A–126D each have a mean arcuate length slightly larger than one half of a wavelength. For reasons given in connection with the first embodiment, a wave within cavities 126A–126D propagates parallel to axis 10A in the basic mode.

Waveguide 126W has an annular end wall 134 (FIG. 7) wherein ports 136–139, similar to ports 36 and 38, communicate with the centers of cavities 126A–126D, respectively. It should be understood that ports 136–139 and the centers of cavities 126A–126D are substantially equidistant from planes 10E and 10H.

A difference mode excitation is concurrently applied to ports 136–139. Ports 136 and 138 are excited either in phase or out of phase with the sum channel excitation; ports 137 and 139 are excited at a phase of either $+90°$ or $-90°$ with respect to the sum channel excitation. Accordingly, the excitation applied to the first pair of opposed cavities is either in phase or out of phase with the sum channel excitation; the excitation applied to the second pair of opposed cavities is at a phase of either $+90°$ or $-90°$ with respect to the sum channel excitation.

To provide the conical scan, the difference mode excitation comprises four steps of a sequence. As shown in FIGS. *9a–9d*, field patterns of difference mode waves that propagate through launching aperture 144 are in response to difference mode excitations respectively associated with the four steps of the sequence. A difference mode excitation and a field pattern are associated with each step of the sequence in accordance with the following table.

Figure 9A:
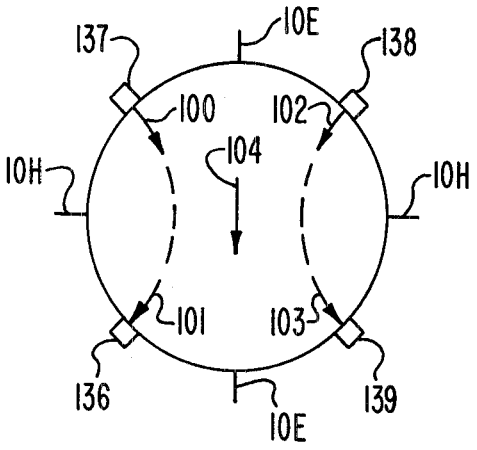
Figure 9B:
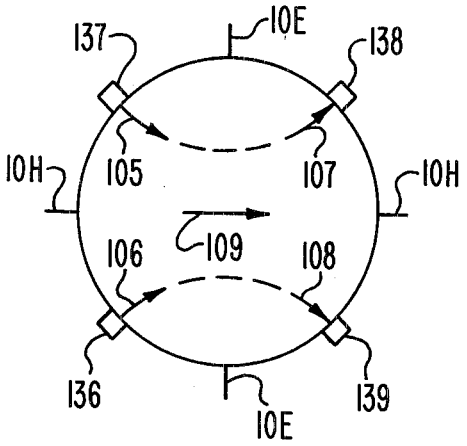
Figure 9C:
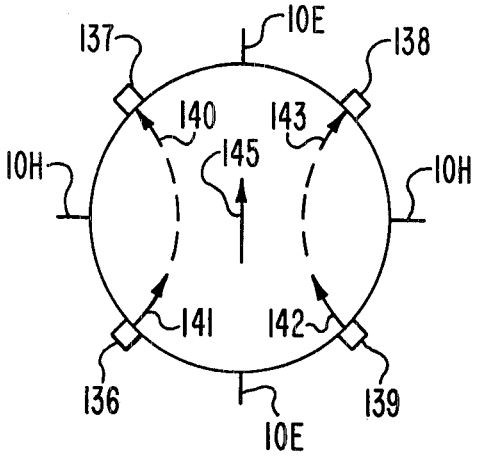
Figure 9D:
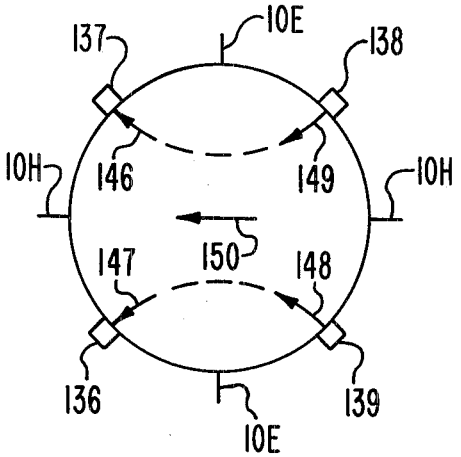

| SEQUENCE STEP NUMBER | PHASE OF EXCITATION APPLIED TO PORTS 136 AND 138 | PHASE OF EXCITATION APPLIED TO PORTS 137 AND 139 | FIGURE THAT SHOWS FIELD PATTERN CAUSED BY EXCITATION |
|---|---|---|---|
| 1 | 0 degrees | +90 degrees | Figure 9a |
| 2 | 0 degrees | −90 degrees | Figure 9b |
| 3 | 180 degrees | −90 degrees | Figure 9c |
| 4 | 180 degrees | +90 degrees | Figure 9d |

excitation applied to ports 136–139 in accordance with sequence step number 1 of the table, a first E plane difference mode wave represented by field vectors 100–103 propagates through launching aperture 144. The first E plane difference mode wave may alternatively be represented by a resultant vector 104 that is in plane 10E. It should be understood that the first E plane difference mode wave is similar to the filtered E plane difference mode wave described in connection with the first embodiment. Moreover, the sum mode wave and the first E plane difference mode wave combine to cause a deflection of the beam in plane 10E similar to that shown in FIG. 5.

As shown in FIG. **9*b*, in response to the excitation applied to ports 136–139 in accordance with entry number 2 of the table, a first H plane difference mode wave represented by vectors 105–108 propagates through launching aperture 144. The first H plane difference mode wave may alternatively be represented by a resultant vector 109 that is in plane 10H. As known to those skilled in the art, the field pattern of FIG. 9*b*** is a representation of a wave that propagates in a $TE_{12}$ mode.

As shown in FIG. 10, within plane 10H the sum mode wave, the first H plane difference mode wave, and the beam are represented by curves 111, 113 and 115, respectively, in a coordinate system where an abscissa 110H is a coordinate that corresponds to locations in the H plane. The coordinate system additionally includes an ordinate line 117, a location thereon being representative of field strength. The sum mode wave and the first H plane difference mode wave combine to cause a deflection of the beam represented as a displacement 119 along abscissa 110H.

As shown in FIG. **9*c*, in response to the excitation applied to ports 136–139 in accordance with sequence step number 3 of the table, a second E plane difference mode wave represented by vectors 140–143 propagates through launching aperture 144. The second E plane difference mode wave may alternatively be represented by a resultant vector 145 that is in plane 10E. In this embodiment, vector 145 is equal in amplitude but opposite in direction to vector 104. The second E plane difference mode wave and the sum mode wave combine to cause a deflection of the beam in plane 10E similar to that shown in FIG. 6**.

As shown in FIG. **9*d*, in response to the excitation applied to ports 136–139 in accordance with sequence step number 4 of the table, a second H plane difference mode wave represented by vectors 146–149 propagates through launching aperture 144. The second H plane difference mode wave may alternatively be represented by a resultant vector 150 that is in plane 10H**.

As shown in FIG. 11, within plane 10H the second H plane difference mode wave and the beam are represented by curves 132 and 134, respectively. Moreover, the sum mode wave and the second H plane difference mode wave combine to cause a deflection of the beam, represented as a displacement 135 along abscissa 110H.

The radiator of the second embodiment includes a spherical lens 176 (FIG. 8) (similar to lens 76 coupled to launching aperture 144 through a waveguide 170 (similar to waveguide 70). Additionally, a matching section 180 (similar to matching section 80) is connected to lens 176, whereby a forward wave radiates from the surface of lens 176 in a manner similar to the radiation of the forward wave from the surface of lens 76 in the first embodiment. Preferably, a cylinder 194, similar to cylinder 94, is included as part of a choke that prevents unwanted radiation from waveguide 170.

What is claimed is:

1. A monopulse radiator, comprising:

a cylindrical multimode waveguide having one end adjacent a circular launching aperture region;

sum channel means connected to the other end of said multimode waveguide for propagating therethrough in a $TE_{11}$ mode a sum mode radio frequency wave in response to a sum channel excitation signal;

a difference channel waveguide having a cavity with an approximately rectangular cross-section that is contiguous with the cavity of said multimode waveguide and where an application of a difference channel excitation signal causes a difference mode wave to propagate therefrom through said launching aperture to combine with said sum mode wave to form a forward wave, one portion of said difference mode wave being propagated in a $TM_{01}$ mode; and coupling means connected to said multimode waveguide for providing a substantially matched impedance coupling of said forward wave to free space, whereby said forward wave forms a radiated beam, said beam being deflected in a selected plane in response to said difference channel excitation being in phase and out of phase with said sum channel excitation.

2. The radiator of claim 1 wherein said connection between said coupling means and said multimode waveguide causes a portion of said sum mode wave to propagate in modes of higher order than said $TE_{11}$ mode within said multimode waveguide, said sum channel means comprising:

a cylindrical sum channel waveguide that has a cavity which may only be excited in said $TE_{11}$ mode, the length of said sum channel waveguide being selected to cause the radiation pattern of said beam to be an approximately axially symmetric Gaussain function; and a coupling iris that couples said multimode waveguide to said sum channel waveguide and is a short circuit termination for a wave propagated in the $TM_{01}$ mode, said coupling iris having a separation distance of one quarter of a wavelength from said launching aperture.

3. The radiator of claim 2 wherein said coupling iris and the cavities of said sum channel, difference channel and multimode waveguides are loaded with a material that has a dielectric constant greater than the dielectric constant of free space.

4. The radiator of claim 3 wherein said coupling means comprises:

a spherical lens made from said material, an aperture of said lens being coupled to said launching aperture; and matching means for providing an impedance match between said lens and free space.

5. The radiator of claim 4 wherein said lens has a center of curvature substantially at the center of said launching aperture.

6. The radiator of claim 4 wherein said coupling means additionally comprises a coupling waveguide made in the general shape of a right truncated cone from said material, a large diameter end of said coupling waveguide and a small diameter end of said coupling waveguide being connected to said lens aperture and said difference channel waveguide, respectively.

7. The radiator of claim 1 wherein said multimode waveguide has a diameter greater than 0.967 wavelengths of said sum mode wave.

8. The radiator of claim 1 wherein said difference channel waveguide is circumferentially disposed about said multimode waveguide and the cavity of said difference channel waveguide has a mean circumference of approximately one wavelength, said difference channel waveguide additionally comprising a pair of radial walls that divide the cavity of said difference channel waveguide into a pair of arcuate cavities of equal length with centers substantially within a plane that includes a vector representative of a magnetic field associated with said radio frequency wave.

9. The radiator of claim 1 wherein said difference channel excitation additionally includes signals at a phase of +90° and −90° with respect to said sum channel excitation, the cavity of said multimode waveguide has a diameter greater than 1.697 wavelengths and the cavity of said difference channel waveguide has a rectangular cross section, a mean circumference of approximately two wavelengths and additionally comprises four radial walls that divide the cavity of said difference channel waveguide into first and second pairs of opposed arcuate cavities of equal length with centers substantially equidistant from planes that include vectors representative of electric and magnetic fields associated with said sum mode wave, said beam being deflected to provide a conical scan in response to said excitation in phase and out of phase with said sum channel excitation being sequentially applied to said first pair of opposed cavities and said excitation at a phase of +90° and −90° with respect to said sum channel excitation being sequentially applied to said second opposed cavities.

10. The radiator of claim 1 wherein a multiplicity of electrically conductive wires are maintained substantially within said launching aperture with a disposition orthogonal to a plane that includes a vector representative of an electric field associated with said sum mode wave.

* * * * *

UNITED STATES PATENT AND TRADEMARK OFFICE
CERTIFICATE OF CORRECTION

PATENT NO. : 4,148,035

DATED : April 3, 1979

INVENTOR(S) : Peter Foldes

It is certified that error appears in the above-identified patent and that said Letters Patent is hereby corrected as shown below:

Column 1, line 35, "a" should be --at--.

Column 2, line 50, "reflected" should be --deflected--.

Column 3, line 28, "were" should be --wave--.

Column 4, line 8, "50" should be --30--.

Column 4, line 51, "ae" should be --are--.

Column 4, line 53, delete "the".

Column 5, line 32, after "mode" insert --wave--.

Column 9, after the table, insert a new paragraph starting as --As shown in FIG. 9a, in response to the--.

Column 10, line 2, after "76" insert --)--.

Signed and Sealed this

*Eighteenth* Day of *September 1979*

[SEAL]

*Attest:*

*Attesting Officer*

LUTRELLE F. PARKER

*Acting Commissioner of Patents and Trademarks*